US007367826B2

(12) United States Patent
Wang et al.

(10) Patent No.: US 7,367,826 B2
(45) Date of Patent: May 6, 2008

(54) COMPOUND CONNECTOR FOR TWO DIFFERENT TYPES OF ELECTRONIC PACKAGES

(75) Inventors: Leland Wang, Hacienda Heights, CA (US); Stelar Chu, Ping-Chen (TW); Aruong Juang, Ping-Chen (TW); Chan-Ming Hsu, Chung-Li (TW); Jiann-Jou Chen, Hsichih Taipei Hsien (TW); Tsan-Lung Tsai, Hsichih Taipei Hsien (TW)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/330,639

(22) Filed: Jan. 12, 2006
(Under 37 CFR 1.47)

(65) Prior Publication Data

US 2006/0276066 A1 Dec. 7, 2006

Related U.S. Application Data

(63) Continuation of application No. 11/135,133, filed on May 23, 2005, now abandoned, which is a continuation of application No. 10/918,160, filed on Aug. 13, 2004, now abandoned, which is a continuation of application No. 10/693,751, filed on Oct. 24, 2003, now abandoned, which is a continuation of application No. 09/599,165, filed on Jun. 22, 2000, now abandoned.

(30) Foreign Application Priority Data

Jun. 14, 2000 (TW) ..... 89210160 U

(51) Int. Cl.
*H01R 13/62* (2006.01)

(52) U.S. Cl. ..... 439/159; 439/630

(58) Field of Classification Search ..... 439/159, 439/153, 160, 152, 155, 630; 361/754; 365/52; 235/380
See application file for complete search history.

(56) References Cited

U.S. PATENT DOCUMENTS 5,368,493 A 11/1994 O'Brien et al. ..... 704/267
5,368,498 A 11/1994 Matsuoka et al. ..... 439/331

(Continued)

FOREIGN PATENT DOCUMENTS

EP 0 834 827 A2 4/1998

(Continued)

*Primary Examiner*—Edwin A. Leon
(74) *Attorney, Agent, or Firm*—Woodcock Washburn LLP

(57) ABSTRACT

Disclosed is a smart card connector for transmitting signals between a smart card and an external electronic system, wherein the smart card has contacts on one of two major surfaces thereof, the connector comprising: guiding structure defining a storage space having a first end and an opposed second end, through which second end, the smart card may be inserted, and contact terminals in the storage space for connecting with the contacts of the smart card to be inserted in the storage space; and an ejecting mechanism provided on the guiding structure and being operable to eject the smart card from the storage space. Further disclosed is a compound connector that comprises two types of I/O connectors, one of which I/O connectors may be a smart connector for use with an external electronic system.

24 Claims, 5 Drawing Sheets

U.S. PATENT DOCUMENTS

| | | | | |
|---|---|---|---|---|
| 5,421,737 | A | 6/1995 | Chen et al. | 439/157 |
| 5,466,166 | A | 11/1995 | Law et al. | 439/159 |
| 5,492,481 | A | 2/1996 | Lewis | 439/159 |
| 5,499,925 | A | 3/1996 | Lwee | 439/157 |
| 5,536,180 | A | 7/1996 | Ishida et al. | 439/159 |
| 5,573,413 | A | 11/1996 | David et al. | 439/159 |
| 5,634,805 | A | 6/1997 | Saito et al. | 439/159 |
| 5,713,750 | A | 2/1998 | Ho | 439/159 |
| 5,778,521 | A | 7/1998 | Law et al. | 29/829 |
| 5,791,920 | A | 8/1998 | Tomioka et al. | 439/159 |
| 5,795,190 | A | 8/1998 | Ono | 439/607 |
| 5,871,365 | A | 2/1999 | Kajiura | 439/159 |
| 5,879,175 | A | 3/1999 | Muramatsu et al. | 439/159 |
| 5,890,920 | A | 4/1999 | David et al. | 439/159 |
| 5,921,792 | A | 7/1999 | Chen | 439/160 |
| 5,967,813 | A | 10/1999 | Ho et al. | 439/159 |
| 5,989,045 | A | 11/1999 | Kimura | 439/159 |
| 5,993,261 | A | 11/1999 | Klatt et al. | 439/630 |
| 6,011,217 | A | 1/2000 | Chen et al. | 174/35 C |
| 6,027,350 | A | 2/2000 | Chen et al. | 439/159 |
| 6,030,238 | A | 2/2000 | Dong | 439/159 |
| 6,036,513 | A | 3/2000 | Nishioka | 439/159 |
| 6,095,834 | A | 8/2000 | Lai et al. | 439/159 |
| 6,095,835 | A | 8/2000 | Oguchi | 439/159 |
| 6,106,313 | A | 8/2000 | Chen | 439/159 |
| 6,116,929 | A | 9/2000 | Muramatsu | 439/159 |
| 6,120,309 | A | 9/2000 | Hara | 439/159 |
| 6,137,710 | A | 10/2000 | Iwasaki et al. | 365/52 |
| 6,139,340 | A | 10/2000 | Niitsu | 439/159 |
| 6,159,027 | A | 12/2000 | Kuo | 439/159 |
| 6,162,075 | A | 12/2000 | Hara et al. | 439/159 |
| 6,210,188 | B1 | 4/2001 | Chang | 439/159 |
| 6,234,813 | B1 | 5/2001 | Hanyu | 439/159 |

FOREIGN PATENT DOCUMENTS

| | | |
|---|---|---|
| EP | 0 940 765 A2 | 9/1999 |
| EP | 0 940 765 A3 | 9/1999 |
| FR | 2 645 667 | 10/1990 |
| GB | 2 330 934 | 5/1999 |
| TW | 483 600 | 4/2002 |

COMPOUND CONNECTOR FOR TWO DIFFERENT TYPES OF ELECTRONIC PACKAGES

CROSS-REFERENCE TO RELATED APPLICATIONS

This is a continuation of U.S. application Ser. No. 11/135,133, filed May 23, 2005 now abandoned, which is a continuation of U.S. application Ser. No. 10/918,160, filed on Aug. 13, 2004 now abandoned, which is a continuation of U.S. application Ser. No. 10/693,751, filed on Oct. 24, 2003 now abandoned, which is a continuation of U.S. application Ser. No. 09/599,165, filed on Jun. 22, 2000 now abandoned, which claims priority to Taiwan Application No. 89210160, filed on Jun. 14, 2000.

FIELD OF INVENTION

This invention is related to a smart connector for use with an external electronic system, such as a desktop or laptop computer. The smart connector is provided with a specially designed ejecting mechanism for ejecting a smart card, which is to be inserted in the connector. This invention further discloses a compound connector device comprising two types of I/O connectors, of which one of the I/O connectors may be a smart connector.

BACKGROUND OF INVENTION

The memory card connector has become indispensable equipment for a portable, or even a desktop computer due to the large amount of various I/O packages that the memory connector is able to work with, such as those as disclosed in U.S. Pat. Nos. 5,890,920, 5,499,925, 5,492,481, 5,368,493, 5,795,190, 5,791,920, 5,871,365, and 6,036,513.

The memory card connector is advantageous in its detachable feature with a memory card, and provides various I/O packages or hardware connections to the portable or desktop computers. However, it has not been able to work with I/O packages that are equipped with contacts on one of two major surfaces of the packages, such as a smart card or a memory stick.

Recent developments in the computer industry signal a large movement towards worldwide web applications and the use of electronic money. They have made smart card applications essential in computer applications that involve electronic money transactions. The information stored in the IC chips of smart cards can further serve as identification means for identifying the persons using the smart card and for identifying the persons over the worldwide web.

Though smart cards have been widely use in the commercial transactions that involve "real money," difficulties still exist in using smart cards in computer applications due the lack of compatible hardware.

Further, though various ejecting mechanisms have been developed in the past, for use with the memory cards, such as those disclosed in U.S. Pat. Nos. 5,967,813, 5,536,180, 5,368,498, 6,030,238, and 5,778,521, they are not appropriate for working with I/O packages that are relatively thin.

SUMMARY OF INVENTION

It is thus a primary object of this invention to provide a specially designed ejecting mechanism that adapts to the relatively thin smart card.

It is a further object of this invention to provide a smart card connector for use with an external electronic system, such as a desktop or laptop computer, wherein the smart card connector is provided with the specially designed ejecting mechanism for ejecting a smart card, which is to be inserted in the connector.

It is a further object of this invention to provide a compound connector device for connecting at least one of a first type of I/O electronic package having first contacts on an end edge thereof, and a second type of I/O electronic package having second contacts on one of the two major surfaces thereof.

It is a further object of this invention to provide a compound connector device that allows the use of a smart card in a desktop or laptop computer, wherein the smart card may serve as identification means for identifying the person using the smart and for identifying the person, or allow "electronic money" transactions over the worldwide web.

To achieve the above objects, this invention discloses an ejecting mechanism for a smart card connector having a card guiding structure, comprising: an ejection member slidably mounted on the guiding structure and a pivot lever being rotatably mounted on the smart card connector; wherein a sliding motion of the ejection member operates an urging end of the pivot lever to rotate between a first position and a second position within the smart card connector.

This invention also discloses a smart card connector for transmitting signals between a smart card and an external electronic system, wherein the smart card has contacts on one of two major surfaces thereof, the connector comprising: a guiding structure defining a storage space; and an ejecting mechanism provided on the guiding structure and being operable to eject the smart card from the storage space.

This invention further discloses a compound connecting device for connecting at least one of a first type of I/O electronic package having first contacts on an end edge thereof, and a second type of I/O electronic package having second contacts on one of the two major surfaces thereof, comprising: a connector section; a first guiding structure extending and defining at least a first storage space for receiving the first type of I/O electronic package; and a second guiding structure affixed to the first guiding structure, and defining at least a second storage space for receiving the second type of I/O electronic package.

The advantages and features of this invention can be easily comprehended by persons skilled in the art when accompanied with the drawings and detailed explanations.

DETAILED DESCRIPTION OF EMBODIMENTS

Figure 1:
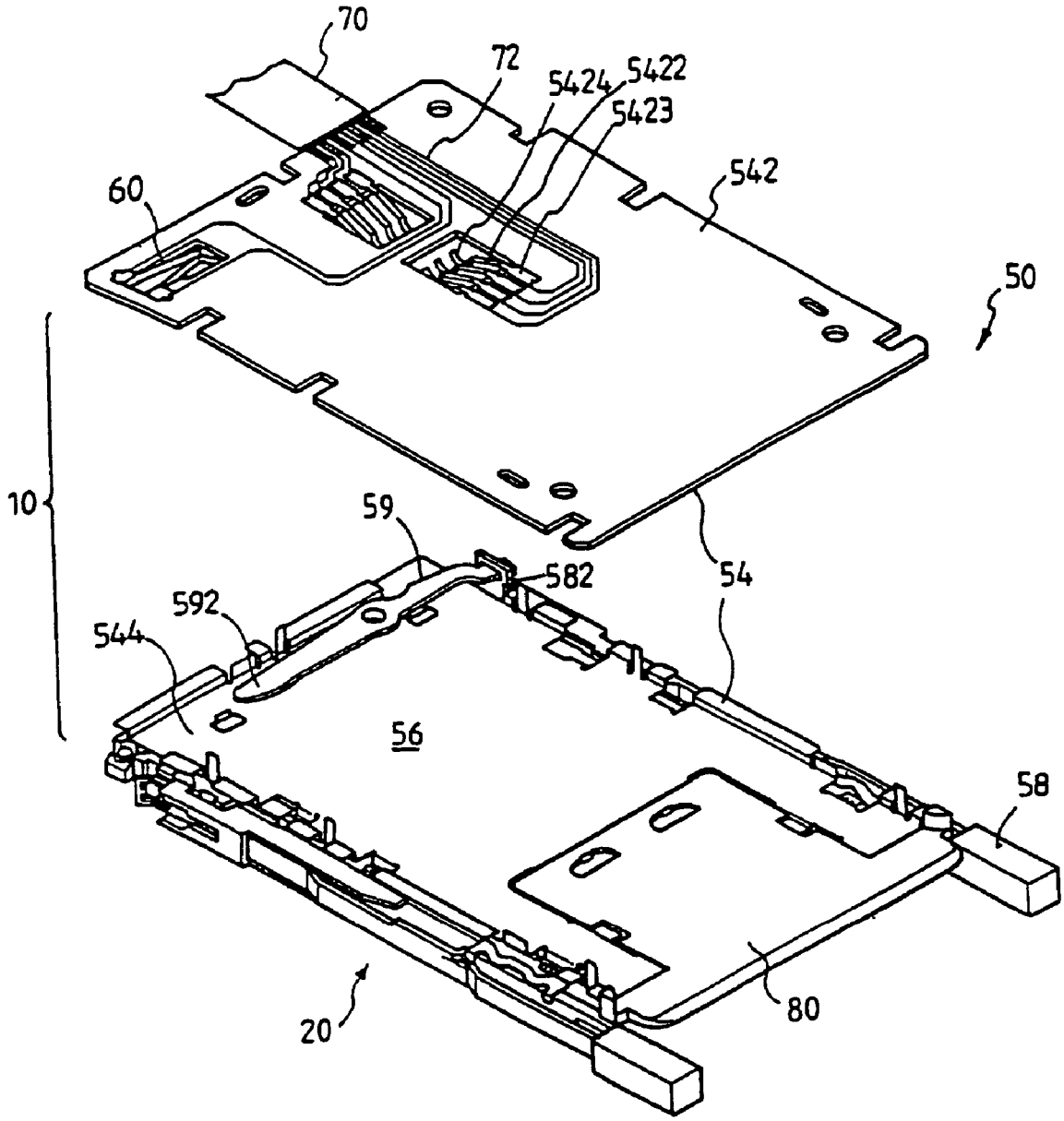
FIG. 1 illustrates a compound connector device of this invention, wherein the smart connector incorporating an ejecting mechanism is illustrated in its exploded, perspective view.

FIG. 1 illustrates a compound connector device 10 of this invention. The compound connector device 10 includes a first connector 20 for connecting with a first type of I/O electronic package, having first contacts on an end edge thereof, such as a memory card or a compact flash. The compound connector device 10 further includes a second connector 50 for connecting with a second type of I/O electronic package having second contacts on one of two major surfaces thereof, such as a smart card or a memory stick.

In this embodiment, the first connector may be any of the memory card connectors commonly used in the computer industry, such as those disclosed in U.S. Pat. Nos. 5,890,920, 5,499,925, 5,492,481, 5,368,493, 5,795,190, 5,791,920, 5,871,365, and 6,036,513.

Figure 2:
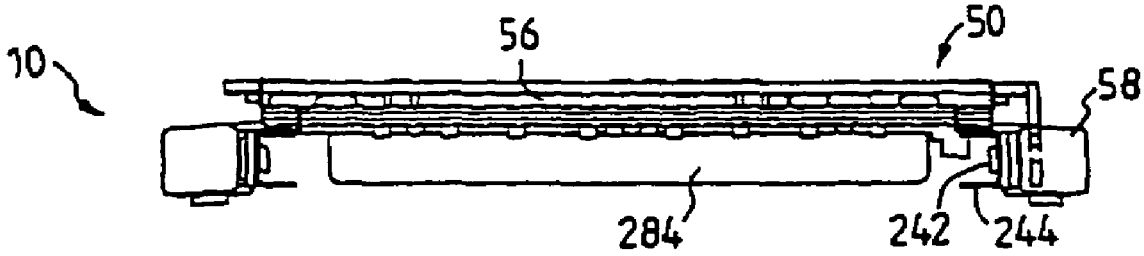
FIG. 2 is an end view showing the compound connector device of FIG. 1.
Figure 5:
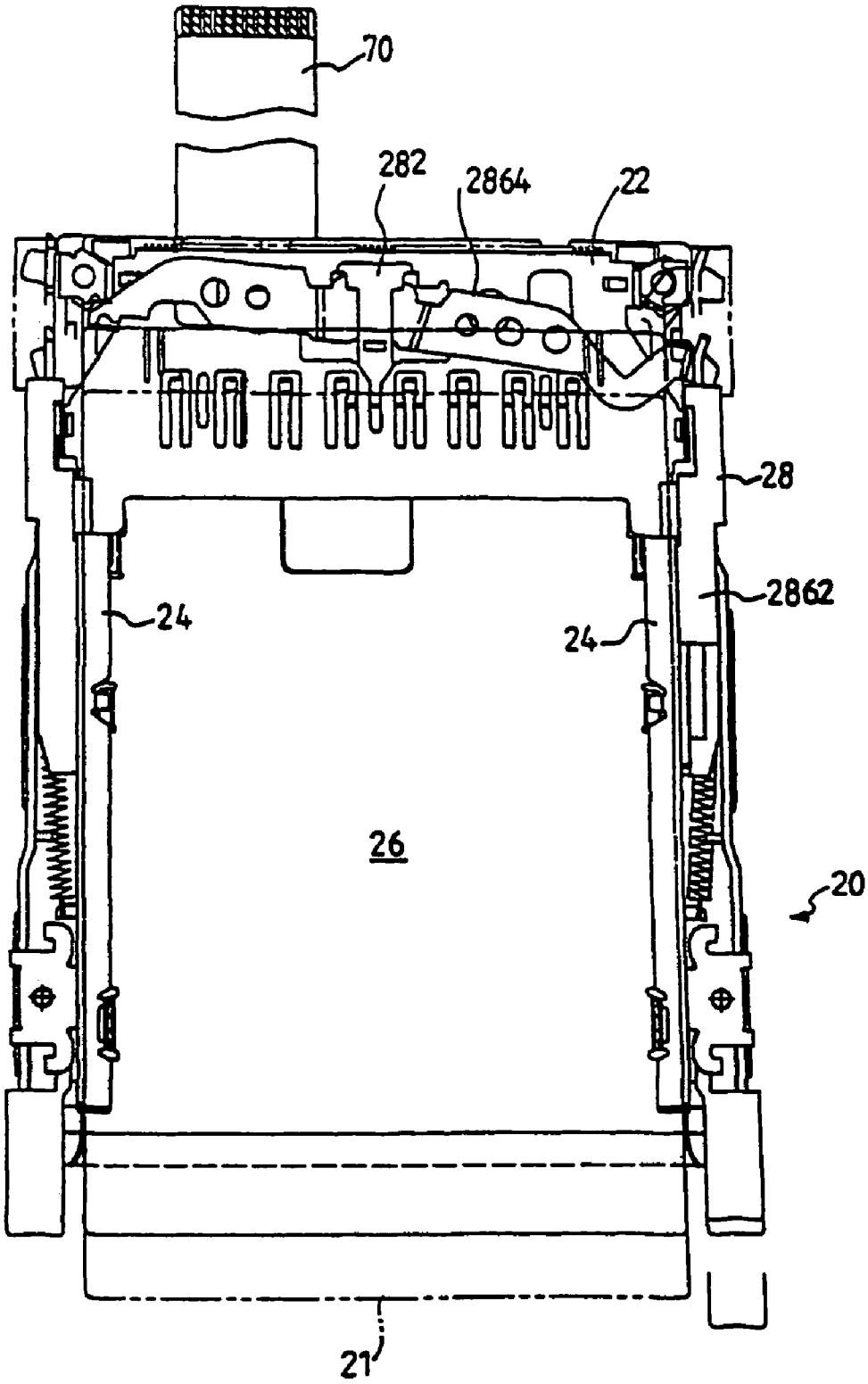
FIG. 5 is a bottom view showing an exemplified memory card connector that may be used in this invention.

For illustrative purposes, rather than limiting the scope of this invention, an exemplified memory card connector 20 is illustrated in FIGS. 1, 2 and 5. The memory card connector 20 includes a connector section 22 and first guiding structure 24 extending lengthwise from the connector section 22 and defining at least a first storage space 26 for receiving the first type of I/O electronic package 51, a memory card in this instance. The connector section 22 has a contact array (not shown) for connecting with the first contacts of the first type of I/O electronic package to be inserted in the first storage space 26.

As best shown in FIG. 2, the first guiding structure 24 comprises a pair of sidewalls 242 and guiding means 244. The side walls 242 are coupled to, and extend from; the connector section 22 in a parallel relation and are spaced at an interval substantially equal to a width of the first type of I/O electronic package. The guiding means 244 longitudinally extends along inner sides of the sidewalls 242.

Returning to FIG. 5, the memory card connector 20 further includes an ejector 28 provided in the first guiding structure 24 and being operable to eject the first type of I/O electronic package from the first storage space 26. The ejector 28 comprises a first package-moving element 282, a slide plate in this embodiment, disposed proximately to the first storage space 26 and being operable to move toward and away from the connector section 22. The first package-moving element 282 has an engagement member 284 (FIG. 2) that extends into the first storage space 26 to be engaged with a forward end face of the first type of I/O electronic package connected to the contact array.

The first package-moving element 282 further comprises a moving means for moving the package-moving element 282 towards and away from the connector section to eject the first type of I/O electronic package from the first storage space 26. The first moving means comprises a first ejection member 2862 and a first pivot lever 2864. The first ejecting member 2862 is movably mounted on the first guiding structure 24 and is operable to move toward and away from the connector section 22. The first pivot lever 2864 is rotatably mounted on the first guiding structure 20 and is arranged to rotate in a plane parallel to the plane of the first package moving means 282. One end of the first pivot lever 2864 is coupled to the first package-moving element 282, and the other end of the first pivot lever 2864 is coupled to the first ejection member 2862.

The ejector 28 of the memory card connector may take on many configurations, such as those disclosed in U.S. Pat. Nos. 5,967,813, 5,536,180, 5,368,498, 6,030,238, and 5,778,521.

As shown in the embodiment of FIGS. 1–4, the second connector is a smart card connector 50. The smart connector 50 includes a second guiding structure 54 that is affixed to the first guiding structure 24, and defines at least a second storage space 56 for receiving the second type of I/O electronic package, such as a smart card 52 shown in FIG. 3.

The second guiding structure 54 comprises a base 542 and a plate 544. The base 542 is affixed to the first guiding structure 24 and covers at least a portion of the first guiding structure 24. The base 542 has contact terminals 5422 thereon facing the plate 544 for connecting with the second contacts of the smart card 52, which is to be inserted in the second storage space 56. The plate 544 is affixed to the base 542 adjacent the first guiding structure 24.

The contact terminals 5422, best shown in FIG. 1, each have a first end 5423 being fixed to the base 542 and a second end 5424 being configured as a cantilever beam for contacting the second contacts of the smart card 52, which is to be inserted in the second storage space 56.

The second connector 50 includes a second ejection member 58 movably mounted on the first 24 or second guiding structure 54 and is able to move towards and away from the connector section 22. The second connector 50 further includes a second package-moving element 59 that is disposed proximately to the second storage space 56 and movably mounted on the plate 544 and arranged to move in a plane parallel to the plane of the base 542. One end of the second package-moving element 59 is coupled to the second ejection member 58.

If the second ejection member 58 is slidably mounted on said first guiding structure 24, the second ejection member 58 may further comprise a drive member 582 extending between the first guiding structure 24 and the second guiding structure 54 for moving the package-moving element 59.

The second package-moving element 59 has an urging part 592, preferably configured to a cam shape, that extends into the second storage space 56 to contact with a forward end edge of the smart card 52, which is to be inserted in the second storage space 56. In this embodiment, the second package-moving element 59 is a pivot lever and the drive member 582 engages one end of the pivot lever 59 that is rotatable between a first and second position. The first position, or the initial position, of the pivot lever 59 is as shown in FIG. 3.

Figure 4:
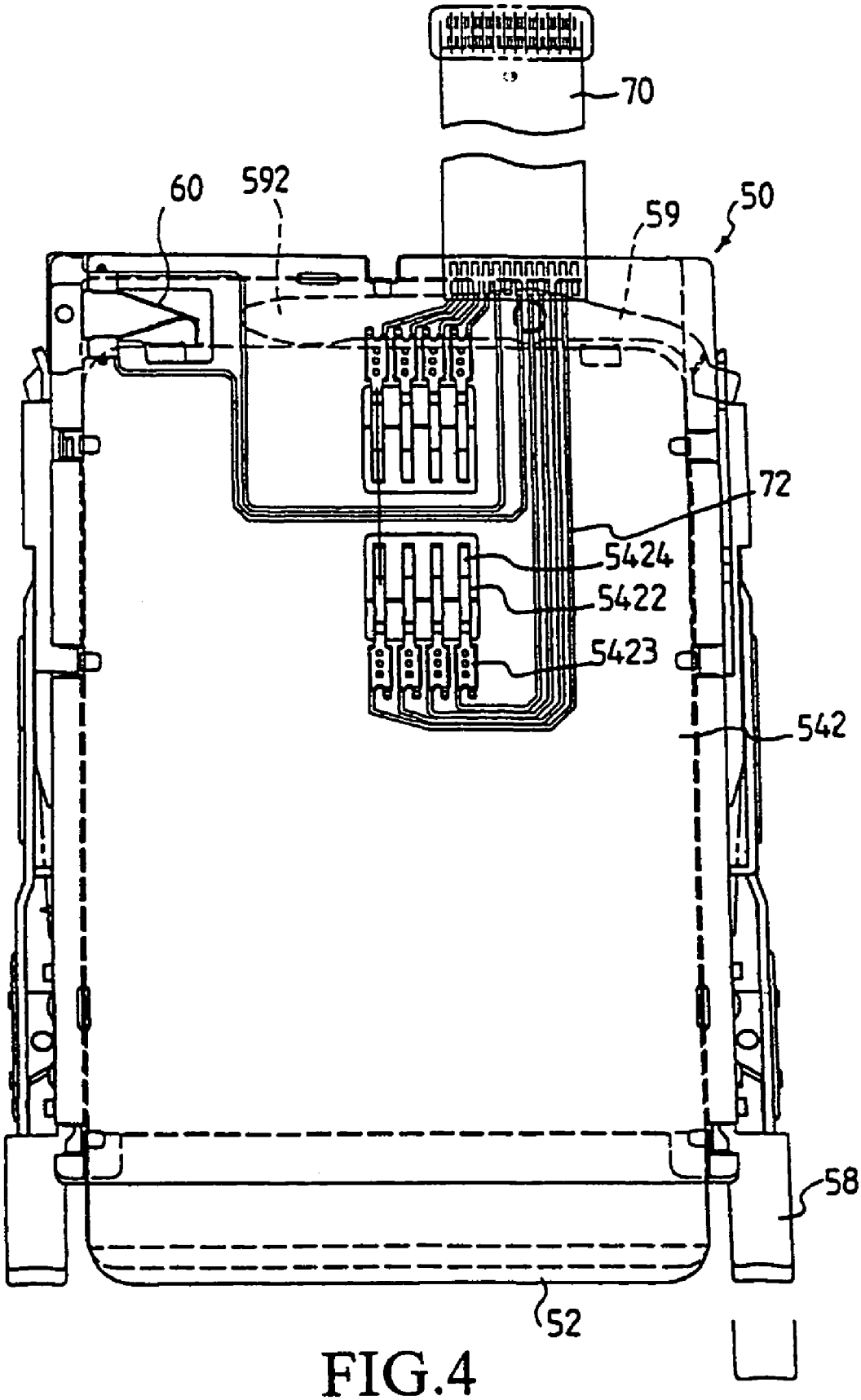
FIG. 4 is a planar view showing the smart card connector after the insertion of a smart connector.

After inserting a smart card 52 into the smart card connector 50, the forward end of the smart card 50 urges against the urging part 592 of the pivot member 59, as shown in FIG. 4. The second pivot lever 59 is in such a position to prevent the smart card 52 from further insertion into the second storage space 56 and locates the smart card 52 in a position in the second storage place so as to properly align the second contacts with the contact terminals 5422 and to obtain signal alignment of the second contacts and the contact terminals 5422.

Figure 3:
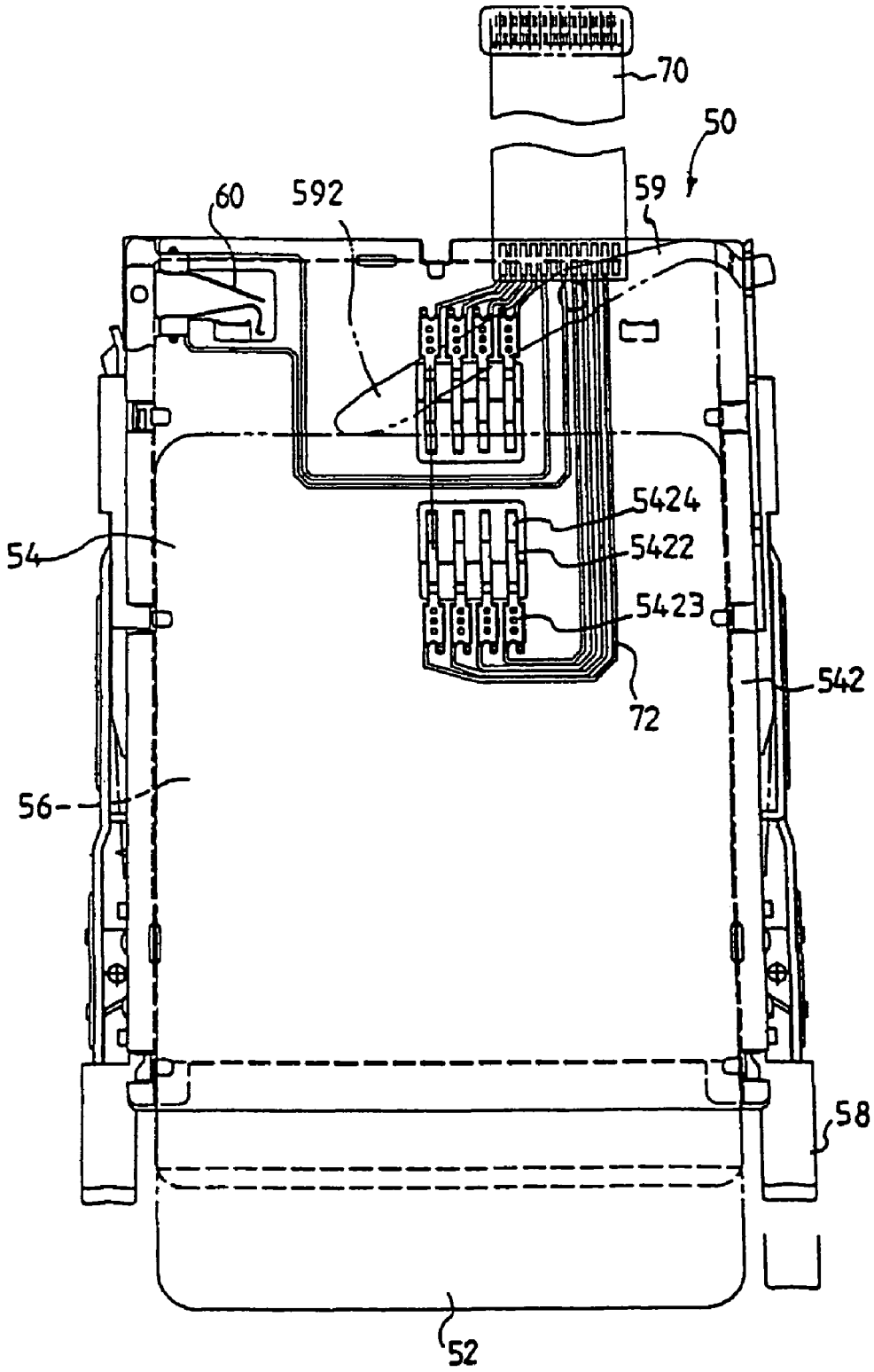
FIG. 3 is a planar view showing the smart card connector after the ejection of a smart card.

To eject the smart card 52, the second ejection member 58 is operated by moving the pivot lever 59 to its the first position, subjecting the urging part 592 of the pivot member 59 to cam towards the forward end of the smart card 52 so as to eject the smart card 52 from the second storage space 56, such as the initial state shown in FIG. 3.

To ensure proper alignment between the second contacts and the contact terminals 5422, the smart connector 50 may further comprise a sensor 60 placed proximately to the second storage space 56 and being operable to provide a signal after full insertion of the smart card 52 into the second storage space 56.

Further, the base 542 of the second guiding structure 54 may comprise a connection means 70 for electrically connecting the second guiding structure 50 to the first guiding structure 20. The connection means 70 may be a flexible cable as illustrated in FIGS. 1–5, or fixed connections between the contact terminals and the contact array.

The base 542 is preferably a PC board; so as to incorporate circuits 72 that electrically connect to the connection means 70. The plate 544 is, preferably, made of metal so as to shield any interference that may be generated by an external electronic device, such as a desktop or laptop computer, to which the compound connector device 10 is mounted.

A guiding plate 80 may further extend outwards from the plate 544 in a direction opposing the connector section 22 for guiding the insertion of the smart connector 52.

While embodying the smart card connector 20 to an external electronic device, a smart card 52 may be inserted into the smart card connector 50 to serve as an identification means for identifying the person using the smart card or identifying the person over the worldwide web. The smart card 52 may even store data relevant to "electronic money" such that the person who owns the smart card 52 may conduct commercial transactions over the worldwide web.

While embodying the compound connector device 10 to an external device, the memory card connector 20 may operate as a conventional connector, that is, for receiving a PCMCIA card, whereas the smart card 52 inserted in the smart card connector 50 may serve as a key to the PCMCIA card that is inserted in the memory card connector 20. In other words, the computer can have access to the contents of the PCMCIA card only if a proper smart card 52 has been inserted into the smart card connector 20.

There are still various applications to which the smart card connector 20 or the compound connector device 10 may be used in the computer industry. The above examples are intended for illustrative purposes, rather than limiting the scope of the invention.

From the invention thus described, it will be obvious that the invention may be varied in many ways. Such variations are not to be regarded as a departure from the spirit and scope of the invention, and all such modifications which would be obvious to one skilled in the art are intended for inclusion within the scope of the following claims.

What is claimed:

1. A compound connector device for connecting at least one of a first type of I/O electronic package having contacts on a leading edge thereof, and a second type of I/O electronic package different from said first type and having a leading edge and two major surfaces and having contacts on one of said two major surfaces thereof, comprising:

a connector section;

first guiding structure connected to and extending lengthwise from the connector section and defining at least a first storage space for receiving the first type of I/O electronic package; the connector section having a contact array for connecting with the first contacts of the first type of I/O electronic package to be inserted in the first storage space; and second guiding structure affixed to the first guiding structure, and defining at least a second storage space for receiving the second type of I/O electronic package, the second guiding structure having contact terminals thereon different from the contact array of said connector section for connecting with the contacts of the second type of I/O electronic package to be inserted in the second storage space;

wherein the first storage space and the second storage space are substantially coextensive.

2. The compound connector device as set forth in claim 1, wherein:

said first type of I/O electronic package is a PCMCIA card; and said second type of I/O electronic package is a smart card.

3. The compound connector device according to claim 1, wherein said smart card is positioned above said PCMCIA card in said compound connector device.

4. The compound connector device as set forth in claim 1, wherein said second guiding structure includes a printed circuit board positioned as a top wall of said connector device.

5. The compound connector device as set forth in claim 1, wherein said second contact terminals protrude downwardly from said printed circuit board into said second storage space.

6. The compound connector device as set forth in claim 1, further comprising:

a first ejector provided on the first guiding structure and being operable to eject the first type of I/O electronic package from the first storage space; and a second ejector provided on the second guiding structure and being operable to eject the second type of I/O package from the second storage space;

wherein said first ejector is mechanically different from said second ejector.

7. The compound connector of claim 1, wherein said leading edge of said first type of I/O electronic package and said leading edge of said second type of I/O electronic package lie in substantially the same plane.

8. The compound connector according to claim 7, wherein said plane is adjacent said connector section.

9. The compound connector device as set forth in claim 1, wherein the second guiding structure comprises a connection for electrically connecting the second guiding structure to the first guiding structure.

10. The compound connector device as set forth in claim 9, wherein the connection is a flexible cable.

11. A compound connector device for connecting a first I/O electronic package having a leading edge and first type of contacts and a second I/O electronic package having a leading edge and a second type of contacts different from said first type of contacts, comprising:

a connector section for connecting said compound connector to an external electronic system;

first guiding structure extending lengthwise from the connector section and defining at least a first storage space for receiving the first I/O electronic package; the connector section having a contact array for connecting with the first type of contacts of the first I/O electronic package to be inserted in the first storage space; and second guiding structure affixed to the first guiding structure, and defining at least a second storage space for receiving the second I/O electronic package, the second guiding structure having contact terminals thereon for connecting with the second type of contacts of the second I/O electronic package to be inserted in the second storage space;

said second I/O electronic package is positioned above said first I/O electronic package in said connector device; and said second guiding structure includes a printed circuit board positioned as a top wall of said connector device.

12. The compound connector device according to claim 11, wherein said first I/O electronic package is different from said second I/O electronic package besides for having different contacts.

13. The compound connector device according to claim 11, wherein said first I/O electronic package is a PCMCIA card and said second I/O electronic package is a smart card.

14. The compound connector device according to claim 13, wherein said smart card is positioned above said PCMCIA card in said compound connector device.

15. The compound connector of claim 11, wherein said leading edge of said first type of I/O electronic package and said leading edge of said second type of I/O electronic package lie in substantially the same plane.

16. The compound connector according to claim 15, wherein said plane is adjacent said connector section.

17. A compound connector device including a memory card connector and a smart card connector, the compound connector device comprising:

a connector section;

a first guiding structure connected to and extending lengthwise from the connector section, the first guiding structure comprising first and second spaced apart sidewalls to define a first storage space for receiving a memory card; and a second guiding structure comprising a base coextensive with and affixed to each of the first and second spaced apart sidewalls, and a plate spaced apart from and facing the base to define a second storage space for receiving a smart card.

18. The compound connector device according to claim 17, wherein the base is a printed circuit board.

19. The compound connector device according to claim 17, wherein the second guiding structure further comprises a separately formed guiding plate extending from the plate in a direction opposing the connector section.

20. A compound connector device for connecting two I/O electronic packages, the compound connector device comprising:

a connector section;

a first guiding structure connected to and extending lengthwise from the connector section and defining a first storage space for receiving a first I/O electronic package; and a second guiding structure comprising a base affixed to the first guiding structure, and a series of individual plate members that are collectively spaced apart from and facing the base to define a second storage space for receiving a second I/O electronic package.

21. The compound connector device according to claim 20, wherein the series of individual plate members includes a plate and a guiding plate extending therefrom.

22. The compound connector device according to claim 21, wherein the guiding plate is substantially parallel to the plate.

23. The compound connector device according to claim 20, wherein connector section, the first guiding structure, and first storage space define a memory card connector.

24. The compound connector device according to claim 23, wherein the second guiding structure and the second storage space define a smart card connector.

* * * * *